United States Patent [19]

Andres et al.

[11] Patent Number: 4,520,863

[45] Date of Patent: Jun. 4, 1985

[54] HEAT-EXCHANGER WITH A BUNDLE OF PARALLELLY EXTENDING PIPES ADAPTED TO BE ACTED UPON BY AIR

[75] Inventors: Rudolf Andres; Helmut Grantz, both of Sindelfingen; Wolf-Dietrich Münzel, Ehningen; Wolfgang Odebrecht, Sindelfingen, all of Fed. Rep. of Germany

[73] Assignee: Daimler-Benz Aktiengesellschaft, Fed. Rep. of Germany

[21] Appl. No.: 436,937

[22] Filed: Oct. 27, 1982

[30] Foreign Application Priority Data

Oct. 31, 1981 [DE] Fed. Rep. of Germany ..... 3143334

[51] Int. Cl.[3] ..... F25B 29/00

[52] U.S. Cl. ..... 165/48 R; 165/42; 165/104.14; 165/104.21; 165/140

[58] Field of Search ..... 165/104.21, 104.26, 165/140, 104.14, 48, 58, 42, 166, 70

[56] References Cited

U.S. PATENT DOCUMENTS

| | | | |
|---|---|---|---|
| 3,603,379 | 9/1971 | Leonard, Jr. | 165/104.21 |
| 3,809,154 | 5/1974 | Heller et al. | 165/104.21 |
| 3,981,354 | 9/1976 | Haberski | 165/179 X |
| 4,333,520 | 6/1982 | Yanadori et al. | 165/104.21 |

FOREIGN PATENT DOCUMENTS

| | | | |
|---|---|---|---|
| 2631092 | 1/1978 | Fed. Rep. of Germany | 165/166 |

*Primary Examiner*—Albert W. Davis, Jr

*Attorney, Agent, or Firm*—Craig & Burns

[57] ABSTRACT

A heat-exchanger with a bundle of parallelly extending pipes adapted to be acted upon by air which are hermetically closed and constructed in the manner of heat-pipes. A heat-exchanger head which is adapted to be traversed by a heat carrier medium extends transversely to the pipe bundle. The heat carrier channels formed therein are sealed off from a flow point of view against the heat-pipe hollow spaces but are in good heat-transferring connection therewith. The heat-exchanger is formed by two types of heat-exchanger plates of which the first type extends over the air stream and the heat-exchanger head and of which the second type of heat-exchanger plates is limited to the heat-exchanger head and extends transversely to the first type of heat-exchanger plates and is brazed thereto over a large surface. The heat-exchanger plates can be constructed as extrusion profiles or as two-layer partial composite laminated bodies; extrusion profiles may also be used for the cross connection of the individual heat-exchanger plates of the same type, which are grooved transversely and are brazed to the end faces of the heat-exchanger plates. However with partial composite laminated bodies, connecting pipes extending transversely to the heat-exchanger plates are preferable.

17 Claims, 8 Drawing Figures

HEAT-EXCHANGER WITH A BUNDLE OF PARALLELLY EXTENDING PIPES ADAPTED TO BE ACTED UPON BY AIR

The present invention relates to a heat-exchanger with a bundle of general parallelly extending pipes adapted to be acted upon by air. A heat exchanger of this same general type is disclosed, for example, in the non-prepublished German Offenlegungsschrift No. 30 31 624.

The heat-exchanger illustrated in the above-noted Offenlegungschrift serves selectively for the cooling or for the heating of the passenger space of a motor vehicle. At the two ends of the pipe bundle, different heat-exchanger heads are provided, of which one is adapted to be acted upon with hot water for heating and the other with a cooling medium for cooling. The distribution of the supplied heat, respectively, of the cooling output onto the air stream takes place by the pipe bundle whose pipes are constructed as so-called heatpipes of conventional construction. Similar arrangements of a heat-exchanger selectively utilizable both for cooling and for heating are disclosed in the German Offenlegungsschrift 27 56 119 and in the German Offenlegungsschrift No. 28 00 265.

A principal object of the present invention resides in the construction of a heat-exchanger which can be manufactured in a rational manner and of which a good heat transfer can be expected between the heat carrier medium and the heat-pipes. The underlying problems are solved according to the present invention in that the pipes and heat-pipe hollow spaces of a pipe row are in the form of a first uniform heat-exchanger plate extending into the air stream and up to the area of the heat-exchanger head. The pipes of the heat-exchanger include channels formed into the heat-exchanger plate, and the heat-exchanger plates are arranged parallelly to the air stream. A further heat-exchanger plate limited to the heat-exchanger head and containing heat carrier channels is coordinated to each first heat-exchanger plate, whereby adjacent heat-exchanger plates are brazed to one another in a heat-conducting manner. Owing to the use of heat-exchanger plates arranged crosswise, of which the one type is limited to the area of the heat-exchanger heads, two mutually separate channel systems can be established within a narrow space, whereby owing to the brazing of the heat-exchanger plates, the two channel systems are intimately connected with each other in a heat conducting manner. The two channel systems which are in heat-exchanging relationship, can be manufactured in a rational and price-favorable manner. By reason of a tight packing of many mutually adjoining channels, a good heat-exchange can be adduced in a small space. The heat-exchanger plates may be constructed as extruded profiles or also as partial composite laminated bodies.

These and other objects, features and advantages of the present invention will become more apparent from the following description when taken in connection with the accompanying drawing which shows, for purposes of illustration only, several embodiments in accordance with the present invention, and wherein.

Figure 1:
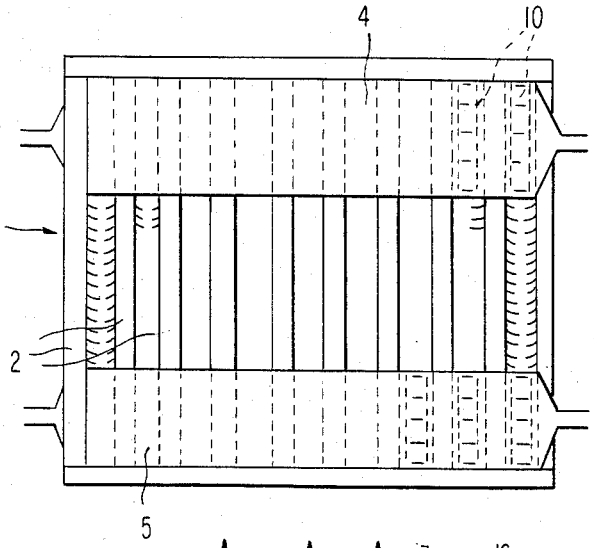
FIG. 1 is an elevational view in the direction of the air stream of a first embodiment of a heat-exchanger according to the present invention, with heat-exchanger plates constructed as extruded profiles.
Figure 2:
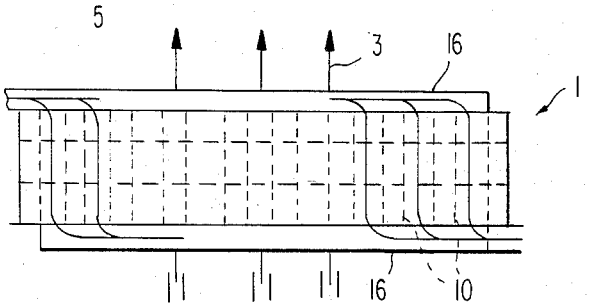
FIG. 2 is a top plan view of the heat-exchanger illustrated in FIG. 1.

Referring now to the drawing wherein like reference numerals are used throughout the various views to designate like parts, the various embodiments of heat-exchangers generally designated by reference numeral 1, 1', 1'' and 1''' illustrated in the different figures, essentially include an upper heat-exchanger head 4, respectively, 4', of a pipe bundle 2, respectively, 2' acted upon by air, with the air stream indicated by reference numeral 3, and of a lower heat-exchanger head 5, respectively, 5'. The individual pipes of the pipe bundle 2 and 2' are designated by reference numerals 6 and 6'. Though they are not constructed as pipes having a circular cross section, they are integrated in the composite arrangement of a heat-exchanger plate; this, however, is not to limit the use of the term "pipes" in its broadest sense. Even though the illustrated embodiments include two heat-exchanger heads, it should also be noted for the sake of completeness that the present invention may also be applied with equal usefulness in connection with heat-exchangers having only a single heat-exchanger head.

The heat-exchangers are formed by two different types of heat-exchanger plates, of which one type extends over the entire height of the heat-exchanger, whereas the other type of the heat-exchanger plates is limited to the respective heat-exchanger head. The first type of the heat-exchanger plate 8, 8', 8'' and 8''' includes the pipes 6 and 6' and the heat-pipe hollow spaces 7 and 7' of the pipe bundle, respectively, of the pipe rows. These heat-exchanger plates 8, 8', 8'' and 8''' extend parallel to the air stream 3 and continue beyond the air stream up the area of the respective heat-exchanger head. Transversely to the direction of the pipes 6 and 6', further heat-exchanger plates 10, 10', 10'' and 10''' are arranged between these first heat-exchanger plates; the further heat exchange plates 10, 10', 10'' and 10''' are disposed parallel to the air stream 3 and contain heat carrier channels 9, 9', 9'' and 9''' which are adapted to be traversed by heat carrier media, for example, heating water or cooling medium. Adjacent heat-exchanger plates of the first and of the further type are brazed together along their abutment sides so that a good heat-conducting connection exists between the same.

In the embodiment illustrated in FIGS. 1 to 4, the two types of the heat-exchanger plates 8 and 9 are constructed in the form of a board-shaped extruded profile which contains several parallel channels extending adjacent one another. In this embodiment, the heat-exchanger plates extending cross-wise to one another inside of the heat-exchanger head are brazed together over the entire extent of the heat-exchanger head and form a compact block, so to speak of. The extruded profiles have in cross section the shape of a ladder and form several rectangular or square channels which represent the pipes. The part of the pipes acted upon by air is provided with heat-transfer ribs or fins which in the embodiment according to FIGS. 1 to 4 are in the form of erected curved ribs 11 peeled shaving-like out of the outer wall.

Figure 3:
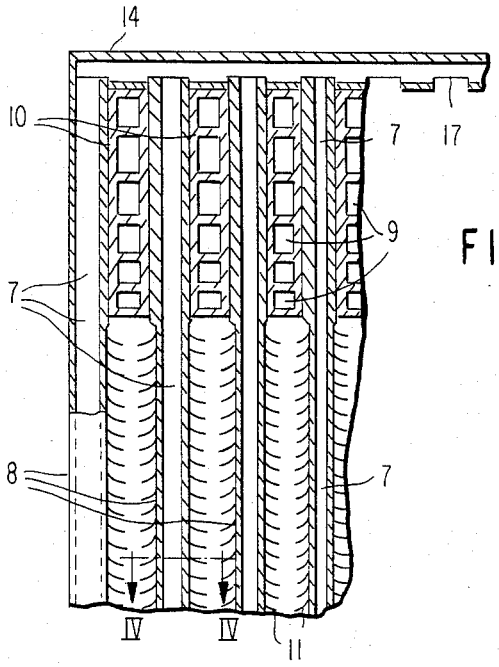
FIG. 3 is a partial cross-sectional view through the heat-exchanger according to FIG. 1, on an enlarged scale compared to FIGS. 1 and 2.
Figure 4:
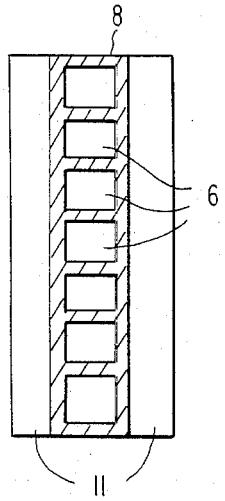
FIG. 4 is a cross-sectional view taken along line IV—IV of the heat-exchanger according to FIG. 3, through the part of a heat-exchanger plate acted upon by air.

The extrusion profiles forming the heat carrier channels 9 are connected with each other by connecting profiles 16 extending transversely thereto, which in cross section have the same shape as the extruded profiles of the heat-exchanger head shown in cross section in FIG. 3. The connecting profiles 16 are provided at the inlet openings of the extrusion profiles of the heat-exchanger plates extending through the heat-exchanger head. The heat-exchanger plates include a groove which, in its width, corresponds to the profile thickness and which intersects the channels of the connecting profiles. The connecting profile prepared in such a manner is mounted over the projecting ends of the heat-exchanger plates under interposition of a so-called soldering or brazing mask at the respective contact places and is sealingly brazed thereto in one operation together with the other brazed connections. One of the end faces of the connecting profile 16 is closed whereas the opposite side of the same connecting profile is provided with an inlet, respectively, with a discharge or outlet connection.

In a manner similar to the heat-exchanger plates 10 of the head, the heat-exchanger plates 8 are connected with each other by transversely extending connecting profiles 14. Whereas with the heat-exchanger plates 10, a connection of the channels 9 for a through-flow of a heat carrier medium is indispensable and functionally necessary, a corresponding cross connection of the heat-pipe hollow spaces 7 of the individual heat-exchanger plates 8 is not necessarily required. However, it is appropriate in order to be able to evacuate several heat-pipe hollow spaces simultaneously and to be able to fill the same intentionally with a suitable medium. Additionally, the temperature level transversely to the air stream is compensated by a cross connection of the heat-pipe hollow spaces disposed adjacent one another in the air stream. Transversely extending grooves 17 are also provided in the connecting profile 14 for the heat-exchanger plates 8, which grooves correspond to the profile thickness and which intersect the channels inside of the extrusion profile 14. As such, the connecting profile 14 does not require any individual channels but could represent a rectangular flat pipe. A subdivision into channels which corresponds exactly to the cross section illustrated in FIG. 4, however, is appropriate for reasons of rigidity. Additionally, a separation of the individual pipes inside of the heat-exchanger plates is achieved by an identical subdivision of the connecting profile 14 as with the heat-exchanger plates 8. As a result thereof, the pipes which lie at different depths inside of the heat-exchanger—as viewed in the air flow direction—can be adjusted individually to different operating points by reason of different fillings so that the tendency of a temperature gradient decreasing in the air flow direction between air, respectively, and the heat-exchanger can be compensated thereby and the heat transfer capacity can be optimized.

Figure 5:
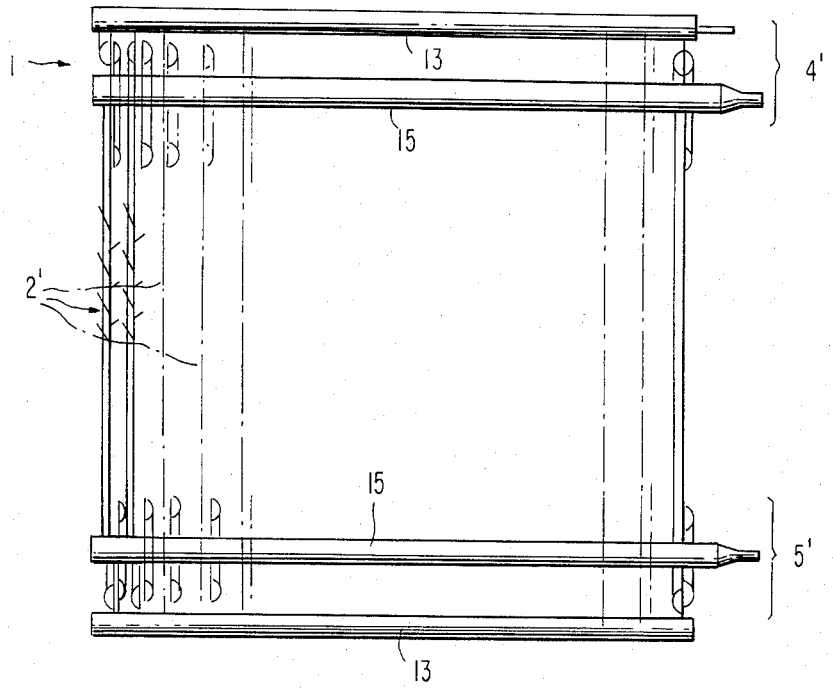
FIG. 5 is an elevational view, also in the direction of the air stream, of a further embodiment of a heat-exchanger according to the present invention with heat-exchanger plates constructed as partial composite laminated bodies.
Figure 6:
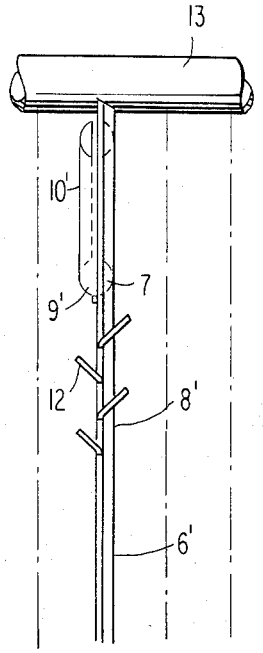
FIG. 6 is a partial section, on an enlarged scale, of the heat-exchanger of FIG. 5.
Figure 7:
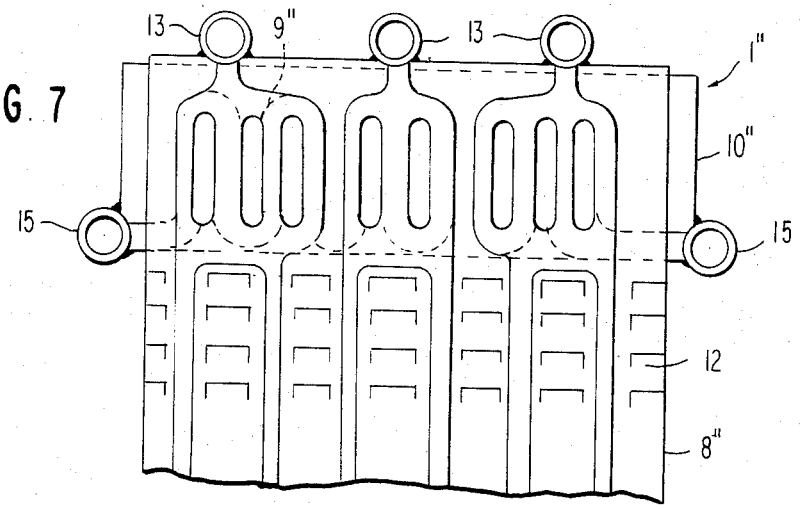
FIG. 7 is a side elevation view of the heat-exchanger shown in FIG. 5.

In the embodiment of a heat-exchanger 1' illustrated in FIGS. 5 and 6, the heat-exchanger plates 8' and 9' are constructed as two-layer partial composite laminated bodies. One side each of the partial composite laminated body is constructed flat and plane; thus, two heat-exchanger plates are brazed together by means of this side completely so that a heat contact with good heat conducting properties and of large area in cross section results between the two. The first heat-exchanger plates 8' which are disposed parallel adjacent one another in the air stream are connected with each other by connecting pipes 13 so that transversely to the air stream all pipes of the bundle 2' possess the same operating point. As shown by the embodiment according to FIG. 7, the pipes can be combined groupwise in the air flow direction in such a manner that the individual groups of heat-pipe hollow spaces disposed one behind the other in the air flow direction do not have any connection with each other. Groups of heat-pipe hollow spaces which are disposed at the same depth in the air flow direction, are connected with each other transversely to the air stream by way of connecting pipes 13. As a result of the group subdivision of the pipes, the aforementioned advantage is achieved that the operating points of the individual heat-pipe hollow spaces can be individually adjusted in the air flow direction so that a tendency of the decrease of the temperature gradient can be counteracted.

In a similar manner, however with a somewhat different purpose, the heat-exchanger plates 10' and 10'' are connected transversely with each other on the inlet side and on the outlet side so that they are adapted to be traversed parallel to one another by a heat carrier medium. The heat carrier channels 9', respectively, 9'' formed within the same, extend appropriately without branching in a manner wherein they meander over the extent of the heat-exchanger plate whereby channel sections of the heat-exchanger channel are disposed congruent with channel sections of the heat-pipe hollow spaces in the heat-exchanger plates 8', respectively, 8'' over as large as possible a length. The heat-pipe hollow spaces of the heat-exchanger plates 8', respectively, 8'' are constructed approximately ladder-shaped within the area of the heat-exchanger heads whereby the channel sections corresponding to the rungs of this ladder are disposed congruent with channel sections of the heat-carrier channels. As a result thereof, short heat transfer paths from one type of channel to the other type of channel are achieved.

The connecting pipes 15 for the further heat-exchanger plates 10', respectively, 10'' are secured in quite a similar manner as the connecting pipes 13 for the first heat-exchanger plates. The transversely extending pipes and the edge of the partial composite laminated bodies are milled-in at the respective inlet places in such a manner that openings with approximately congruent spatial configuration of the boundary contour result. The parts are sealingly brazed to one another by interposition of a corresponding soldering mask and by placing the same one on the other and by clamping fast the connecting pipe.

Also, in the embodiments in which the heat-exchanger plates are formed by partial composite laminated bodies, the heat transfer is improved by heat transfer ribs at the part of the heat-exchanger plates acted upon by air. In this case, the heat transfer ribs are formed in the shape of transversely projecting tongues or fins 12 which are displaced out of wall portions of the heat-exchanger plates, and the wall portions disposed between the pipes are utilized for this purpose.

Figure 8:
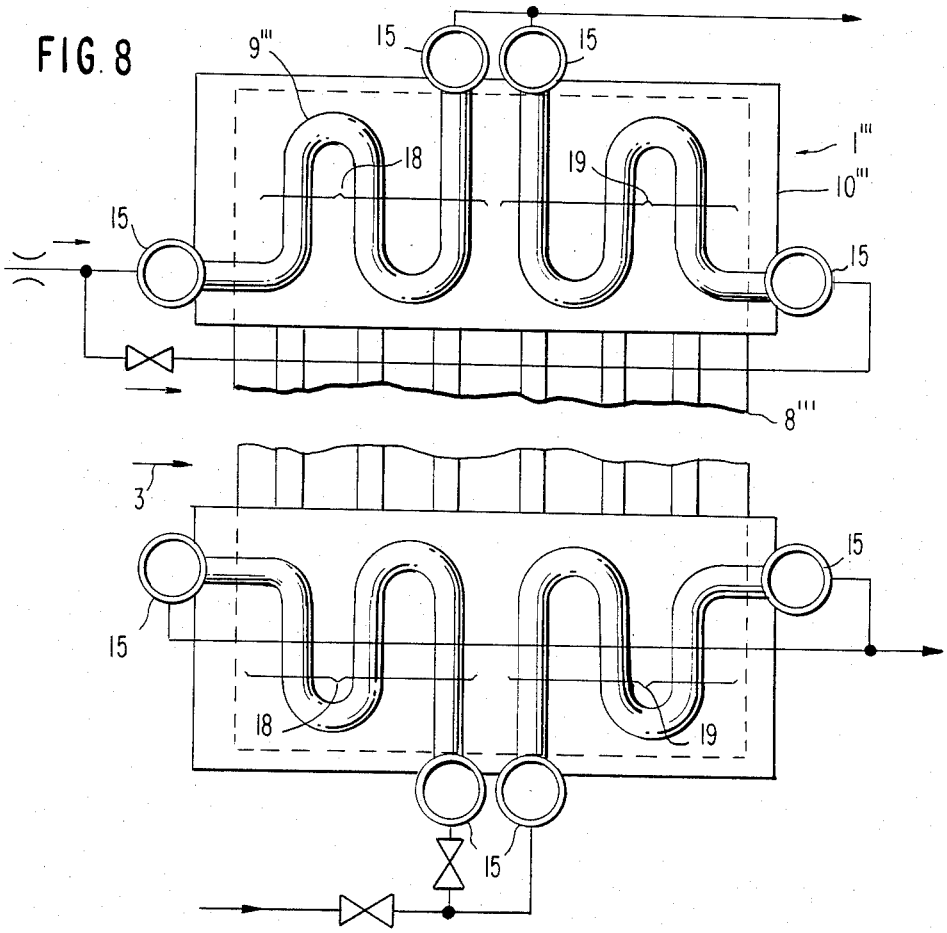
FIG. 8 is an elevational view of a further embodiment of a heat-exchanger according to the present invention with partial composite laminated bodies as heat-exchanger plates and with subdivision of the heat-exchanger heads into sections for drying the treated air.

The further embodiment of a heat-exchanger generally designated by reference numeral 1''' illustrated in FIG. 8 is characterized essentially in that the two heat-exchanger heads are subdivided into two sections 18 and 19 disposed one behind the other in the direction of the air flow. The upper heat-exchanger head is adapted to be acted upon with a tempered heat carrier medium colder than the dew point temperature of the acted-upon air, for example, with a liquid cooling medium, whereas the lower heat-exchanger head is adapted to be traversed by a tempered heat carrier medium, for example, by heating water tempered warmer than room temperature. Two independent heat carrier channels 9''' are formed in the further heat exchanger plates 10''' which each by itself are transversely connected with each other by means of connecting pipes 15. As a result thereof, the aforementioned independent sections are formed inside of the heat-exchanger heads, of which the one section 18 is located first in the air stream and the other section 19 is disposed rearmost in the air stream; both sections 18 and 19 are of equal size in the illustrated embodiment.

Owing to the subdivision of the heat-exchanger heads into two sections disposed one behind the other, these sections can be turned off individually so that only one of the sections and correspondingly the associated part of the pipe bundle can be acted upon by itself in an isolated manner. Such a construction of the heat-exchanger, respectively, of the heat-exchanger heads is purposeful for the drying of humid air. For that purpose, the three first pipes of the pipe rows disposed in the air stream are cooled in that cooling medium is supplied to the upper heat-exchanger head whereby the rear section of this heat-exchanger head is turned off and correspondingly the three rear pipe rows are not cooled. At the same time, however, the lower heat-exchanger head is acted upon with heating water whereby in that case the forward section is rendered inoperative and only the rear pipes of the pipe rows are heated. As a result of such a manner of operation, the humidity can be removed from the air supplied through the heat-exchanger in that the moisture condenses at the forward cold pipes; subsequently, the cooled-off air is again heated to normal temperature at the rear pipes so that the dried air, respectively, is retained at normal temperature.

The manner of operation of the other heat-exchangers with two heat-exchanger heads which, however, are not subdivided into sections is briefly as follows:

Only one of the two heat-exchanger heads is acted upon at the same time; with the use of a heat-exchanger according to FIG. 8, the two sections are connected in parallel and also only one of the two heat-exchanger heads is acted upon over its full width. During the heating, the medium present in the heat pipe hollow spaces is evaporated in the lower region, rises in the pipes, gives off the heat to the air stream by way of the pipe walls and condenses on the inside of the pipes; the condensate runs back by gravitational influence and/or by capillary action of a corresponding structure of the pipe inside to the heated place so that the circulation closes. During the cooling of the air stream, of course, the heating water supply is turned off and instead cooling medium to be evaporated is conducted through the upper heat-exchanger head. During this type of operation, the medium disposed in the heat pipe hollow spaces is evaporated in the pipes of the bundle exposed to the air stream whereby heat is removed from the air. The evaporated medium rises on the inside of the pipes and condenses in the sections of the heat pipe hollow spaces disposed in the upper heat-exchanger head, whereby the absorbed heat is transferred to the cooling medium and the latter evaporates. The formed condensate runs back downwardly into the part of the heat pipe hollow spaces which are exposed to the air stream by gravitational influence and/or by capillary action on the pipe inside, as a result of which the circulation again also closes. In every case, the condensation portion of the heat pipe hollow space is arranged above the evaporating portion as viewed in the gravitational direction so that a condensate return flow is favored by gravitational influence. This has a favorable influence on a high capacity heat transfer.

Partial composite laminate bodies or structures, as the term is used herein are such structures, also known as so-called "Roll-Bond" plates or structures, which consist, for example, of a corresponding number of aluminum plates that are imprinted with a separating substance at those places where the plates are intended to form hollow spaces and are subsequently rolled together, one lying upon the other, as a result of which the plates are intimately welded together by the rolling pressure and the materials deformation at the non-imprinted places. By blowing compressed air into the nonwelded places, the gaps located thereat are inflated or expanded into channels whereby a corresponding shaping tool assures a defined pneumatic channel enlargement.

While we have shown and described several embodiments in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

We claim:

1. A heat-exchanger with a bundle of pipe means extending substantially parallelly and arranged in at least one row, said bundle of pipe means being hermetically closed and being constructed in the manner of heat-pipe means forming heat-pipe hollow spaces, and at least one heat-exchanger head means adapted to be traversed by a heat carrier medium and extending transversely to the bundle of pipe means, said heat-exchanger head means being sealed off with respect to the heat-pipe hollow spaces of the bundle of pipe means and in heat-transferring connection therewith;

said bundle of pipe means and heat pipe hollow spaces of a pipe row being in the form of a first heat-exchanger plate means extending in an air stream and up to the area of the heat-exchanger head means, the pipes of said bundle of pipe means being formed by channel means formed in the heat-exchanger plate means;

the first heat-exchanger plate means being arranged substantially parallel to the air stream;

a second heat-exchanger plate means containing heat-carrier channel means and limited to the heat-exchanger head means being coordinated to each first heat-exchanger plate means, adjacent first and second heat-exchanger plate means being heat-conductingly connected to each other; and the heat pipe hollow spaces forming pipes of different heat-exchanger plate means, which heat pipe hollow spaces are disposed at approximately the same depth in the air stream, are connected with each other transversely to the air stream.

2. A heat-exchanger according to claim 1, wherein the heat-exchanger plate means are metallic and are heat-conductingly brazed to one another.

3. A heat-exchanger according to claim 1 or 2, wherein the pipes of the heat-exchanger plate means are arranged in several rows of substantially equal length and disposed parallelly adjacent one another.

4. A heat-exchanger according to claim 1, wherein at least one of the first and second heat-exchanger plate means is in the form of a board-shaped extrusion profile means containing several channel means extending parallelly adjacent one another.

5. A heat-exchanger according to claim 1, wherein at least one of the first and second heat-exchanger plate means are each in the form of an expanded partial composite laminated body means.

6. A heat-exchanger according to claim 1, wherein the part of the first heat-exchanger plate means exposed to the air stream is provided with heat-transferring rib means.

7. A heat-exchanger according to claim 6, wherein the heat-transfer rib means is in the shape of erected curbed ribs peeled off shaving-like out of the outer wall.

8. A heat-exchanger according to claim 6, wherein the heat transfer rib means are constructed in the shape of transversely directed tongues which ar punched-out of those wall portions of a partial composite laminated body means forming the first heat-exchanger plate means which are disposed between the heat-pipe hollow spaces forming the pipes of said heat-exchanger plate means.

9. A heat-exchanger according to claim 1, with heat-exchanger plate means constructed as extrusion profile means, wherein the cross connection of the heat-exchanger plate means takes place by at least one similar extrusion profile means, the transversely extending extrusion profile means being provided at each inlet place of a heat-exchanger plate means with transversely milled-in grooves intersecting the channel means and corresponding in its width to the profile thickness, said grooves being each brazed in a flush and sealing manner with the end faces of the heat-exchanger plate means.

10. A heat-exchanger according to claim 1, with heat-exchanger plate means constructed as partial composite laminated body means, wherein the cross connection of the heat-exchanger plate means takes place by at least one pipe means, the transversely extending pipe means and the edge of the partial composite laminated body means being provided at the respective inlet places with milled-in openings that are sealingly brazed together to one another.

11. A heat-exchanger according to claim 1, 4 or 5, wherein heat-exchanger head means are provided at each of the two ends of the pipe bundle, one of said heat exchanger head means being adapted to be acted upon with a heat carrier medium warmer than room temperature and the other heat exchanger head means adapted to be acted upon by a heat carrier medium colder than the dew point temperature of the acted-upon air;

the second heat-exchanger plate means being subdivided into two independent sections disposed one behind the other, as viewed in the air flow direction, and each being provided with separate inlet and outlet connections;

the forward sections as viewed in the air flow direction of the adjacent heat-exchanger plate means and the rear sections being each combined from a flow point of view separately by connecting line means in such a manner that only a portion of the pipe rows of the bundle of pipe means is adapted to be acted upon isolated by one heat-exchanger head means and the other part of the pipe rows are adapted to be acted upon simultaneously by the other heat-exchanger head means.

12. A heat-exchanger with a bundle of pipe means extending substantially parallelly and arranged in at least one row, said bundle of pipe means being hermetically closed and being constructed in the manner of heat-pipe means forming heat-pipe hollow spaces, and at least one heat-exchanger head means adapted to be traversed by a heat carrier medium and extending transversely to the bundle of pipe means, said heat-exchanger head means being sealed off with respect to the heat-pipe hollow spaces of the bundle of pipe means and in heat-transferring connection therewith;

said bundle of pipe means and heat pipe hollow spaces of a pipe row being in the form of a first heat-exchanger plate means extending in an air stream and up to the area of the heat-exchanger head means, the pipes of said bundle of pipe means being formed by channel means formed in the heat-exchanger plate means;

the first heat-exchanger plate means being arranged substantially parallel to the air stream;

a second heat-exchanger plate means containing heat-carrier channel means and limited to the heat-exchanger head means being coordinated to each first heat-exchanger plate means, adjacent first and second heat-exchanger plate means being heat-conductingly connected to each other;

the heat pipe hollow spaces disposed forwardly in the air stream and forming pipes of the heat-exchanger plate means are separated from heat pipe hollow spaces disposed further rearwardly in the air stream; and the heat pipe hollow spaces forming pipes of different heat-exchanger plate means, which heat pipe hollow spaces are disposed at approximately the same depth in the air stream, are connected with each other transversely to the air stream.

13. A heat-exchanger according to claim 6 or 12 wherein at least one of the first and second heat exchanger plate means is the form of a board-shaped extrusion profile means containing several channel means extending parallelly adjacent one another.

14. A heat-exchanger according to claim 6 or 12, wherein at least one of the first and second heat-exchanger plate means is in the form of an expanded partial composite laminated body means.

15. A heat-exchanger with a bundle of pipe means extending substantially parallelly and arranged in at least one row, said bundle of pipe means being hermetically closed and being constructed in the manner of heat-pipe means forming heat-pipe hollow spaces, and at least one heat-exchanger head means adapted to be traversed by a heat carrier medium and extending transversely to the bundle of pipe means, said heat-exchanger head means being sealed off with respect to the heat-pipe hollow spaces of the bundle of pipe means and in heat-transferring connection therewith;

said bundle of pipe means and heat pipe hollow spaces of a pipe row being in the form of a first heat-exchanger plate means extending in an air stream and up to the area of the heat-exchanger head means, the pipes of said bundle of pipe means being formed by channel means formed in the heat-exchanger plate means;

the first heat-exchanger plate means being arranged substantially parallel to the air stream;

a second heat-exchanger plate means containing heat-carrier channel means and limited to the heat-exchanger head means being coordinated to each first heat-exchanger plate means, adjacent first and second heat-exchanger plate means being heat-conductingly connected to each other;

said heat-exchanger plate mens being metallic and heat-conductingly brazed to one another;

at least one of the first and second heat-exchanger plate means being in the form of a board-shaped extrusion profile means containing several channel means extending parallelly adjacent one another; and the heat pipe hollow spaces forming pipes of different heat-exchanger plate means, which heat pipe hollow spaces are disposed at approximately the same depth in the air stream, are connected with each other transversely to the air stream.

16. A heat-exchanger with a bundle of pipe means extending substantially parallelly and arranged in at least one row, said bundle of pipe means being hermetically closed and being constructed in the manner of heat-pipe means forming heat-pipe hollow spaces, and at least one heat-exchanger head means adapted to be traversed by a heat carrier medium and extending transversely to the bundle of pipe means, said heat-exchanger head means being sealed off with respect to the heat-pipe hollow spaces of the bundle of pipe means and in heat-transferring connection therewith;

said bundle of pipe means and heat pipe hollow spaces of a pipe row being in the form of a first heat-exchanger plate means extending in an air stream and up to the area of the heat-exchanger head means, the pipes of said bundle of pipe means being formed by channel means formed in the heat-exchanger plate means;

the first heat-exchanger plate means being arranged substantially parallel to the air stream;

a second heat-exchanger plate means containing heat-carrier channel means and limited to the heat-exchanger head means being coordinated to each first heat-exchanger plate means, adjacent first and second heat-exchanger plate means being heat-conductingly connected to each other;

said heat-exchanger plate means being metallic and heat-conductingly brazed to one another;

heat-transfer rib means on the part of the first heat-exchanger means exposed in the air stream; and the heat pipe hollow spaces forming pipes of different heat-exchanger plate means, which heat pipe hollow spaces are disposed at approximately the same depth in the air stream, are connected with each other transversely to the air stream.

17. A heat-exchanger with a bundle of pipe means extending substantially parallelly and arranged in at least one row, said bundle of pipe means being hermetically closed and being constructed in the manner of heat-pipe means forming heat-pipe hollow spaces, and at least one heat-exchanger head means adapted to be traversed by a heat carrier medium and extending transversely to the bundle of pipe means, said heat-exchanger head means being sealed off with respect to the heat-pipe hollow spaces of the bundle of pipe means and in heat-transferring connection therewith;

said bundle of pipe means and heat pipe hollow spaces of a pipe row being in the form of a first heat-exchanger plate means extending in an air stream and up to the area of the heat-exchanger head means, the pipes of said bundle of pipe means being formed by channel means formed in the heat-exchanger plate means;

the first heat-exchanger plate means being arranged substantially parallel to the air stream;

a second heat-exchanger plate means containing heat-carrier channel means and limited to the heat-exchanger head means being coordinated to each first heat-exchanger plate means, adjacent first and second heat-exchanger plate means being heat-conductingly connected to each other;

said heat-exchanger plate means being metallic and heat-conductingly brazed to one another;

at least one of the first and second heat-exchanger plate means being in the form of a board-shaped extrusion profile means containing several channel means extending parallelly adjacent one another;

heat-transfer rib means on the part of the first heat-exchanger means exposed in the air stream;

said heat-transfer rib means being in the shape of erected curbed ribs peeled off shaving-like out of the outer wall; and the heat pipe hollow spaces forming pipes of different heat-exchanger plate means, which heat pipe hollow spaces are disposed at approximately the same depth in the air stream, are connected with each other transversely to the air stream.

* * * * *